US010794015B2

(12) United States Patent
Schuette et al.

(10) Patent No.: US 10,794,015 B2
(45) Date of Patent: Oct. 6, 2020

(54) ASPHALT SCREED EXTENSION TUBE ADJUSTMENT ASSEMBLY

(71) Applicant: Caterpillar Paving Products Inc., Brooklyn Park, MN (US)

(72) Inventors: Ryan J. Schuette, Saint Michael, MN (US); John Jorgensen, Andover, MN (US); Tobin D. Rasmusson, Bloomington, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 189 days.

(21) Appl. No.: 16/159,341

(22) Filed: Oct. 12, 2018

(65) Prior Publication Data

US 2020/0115860 A1 Apr. 16, 2020

(51) Int. Cl.
*E01C 19/48* (2006.01)
*E01C 19/40* (2006.01)

(52) U.S. Cl.
CPC ..... *E01C 19/4833* (2013.01); *E01C 19/405* (2013.01); *E01C 2301/16* (2013.01)

(58) Field of Classification Search
CPC ..... E01C 2301/16; E01C 19/4833; E01C 19/405; E01C 19/48
See application file for complete search history.

(56) References Cited

U.S. PATENT DOCUMENTS 2,182,237 A * 12/1939 Rasmussen ..... B60T 11/165 60/589
3,252,697 A * 5/1966 Rumsey ..... F16F 9/368 267/129
3,501,183 A * 3/1970 Stratienko ..... F16D 1/08 403/370
3,992,124 A * 11/1976 Schrader ..... E01C 19/4833 404/118
4,272,213 A * 6/1981 McGovarin ..... E01C 19/40 404/104
4,502,813 A 3/1985 Hojberg
4,702,642 A * 10/1987 Musil ..... E01C 19/405 404/118
4,869,618 A 9/1989 Morrison
4,969,773 A * 11/1990 Heims ..... E01C 19/42 404/104

(Continued)

*Primary Examiner* — Abigail A Risic
(74) *Attorney, Agent, or Firm* — Miller, Matthias & Hull

(57) ABSTRACT

A screed assembly for a paving machine is disclosed including a main screed portion and a screed extension portion being laterally exterior to the main screed portion. Furthermore, a screed extension tube is coupled to a screed frame and a screed extension portion frame, the screed extension tube adjusts a width of the screed extension portion. The screed assembly may further include an extension tube support mechanism having a bushing circumferentially surrounding the screed extension tube and disposed within a bushing recess defined in the screed extension portion frame. The extension tube support mechanism further having a retainer ring that circumferentially surrounds and is in direct contact with at least a portion of the bushing, and the retainer ring is capable of being adjusted between the bushing and the screed extension portion frame to eliminate an uncontrolled movement of the screed extension tube and the screed extension portion.

20 Claims, 5 Drawing Sheets

(56) References Cited

U.S. PATENT DOCUMENTS

| | | | | |
|---|---|---|---|---|
| 5,222,829 | A * | 6/1993 | Mogler | E01C 19/407 404/118 |
| 5,924,819 | A * | 7/1999 | Breidenbach | E01C 19/42 404/104 |
| 6,019,544 | A * | 2/2000 | Emerson | E01C 19/405 404/104 |
| 8,864,410 | B1 * | 10/2014 | Kopacz | E01C 19/48 404/118 |
| 2017/0233958 | A1 * | 8/2017 | Utterodt | E01C 19/4833 701/50 |

* cited by examiner

ASPHALT SCREED EXTENSION TUBE ADJUSTMENT ASSEMBLY

TECHNICAL FIELD

The present disclosure relates generally to an extendable screed assembly for a paving machine, and more particularly to a sliding support system that allows for adjustment of the screed extension portion of the screed assembly.

BACKGROUND

A paving machine, such as an asphalt paver, is generally a self-propelled machine designed to receive, convey, distribute, and partially compact paving material, such as asphalt. Typically, the paving machine receives the paving material in a hopper positioned at the front of the machine, conveys the paving material from the hopper to the rear of the machine with parallel slat conveyors, distributes the paving material along a desired width, and compacts the paving material into a mat with a screed. The width of the screed, which may be adjustable, typically defines the capable paving width of a particular paving machine. More specifically, some paving machines include screed portions that are extendible and retractable using hydraulic actuators or other such actuating assemblies. As a result, some paving machines are able to adjust the screed in a substantially lateral direction to increase and/or decrease the paving width, as desired. Mechanical extensions, or screed extensions, may also be utilized for increasing the paving width provided by the base screed.

The hydraulic, or other such, actuating assemblies coupled to the screed are tasked with extending and retracting the screed extension portion to the desired screed width. To facilitate adjustment of the screed extension portion, the actuating assembly includes a number of bushings and/or bearings that work with the hydraulic actuators during operation of the paving machine. Once the screed is in an extended position the actuating assemblies may be further required to provide support to minimize uncontrolled and undesired movement of the screed extension portion. Oftentimes, the bushings, bearings and other actuating assembly components are numerous and difficult to access. Thus, adjustment of an extension mechanism that is coupled to a screed extension portion, particularly when conducted in the field, can be difficult, time-consuming, costly, and may require equipment that is not readily available.

U.S. Pat. No. 4,502,813 to Hojberg, (hereinafter the '813 patent), teaches an asphalt laying machine that includes a rear body having a centrally placed main screed and two side screeds, one on either side of the main screed. The '813 patent further teaches the main screed having a rigid first frame secured to arms that extend rearward in relation to the first frame with the purpose of guiding and carrying a second rigid frame of the side screeds so as to make the side screeds displaceable in parallel with and immediately behind the main screed. Furthermore, the second frame is attached to one or more smooth shafts adapted to slide in associated bushings at the rearward ends of the arms and hydraulic means may be used for displacing the second frame relative to the first frame to positions between an outer position where an asphalt course laid has a maximum width and an inner position where the asphalt course laid has a minimum width.

The present disclosure is directed to improving the state of the art set forth above.

SUMMARY OF THE DISCLOSURE

In one aspect of the disclosure, a screed assembly for a paving machine adjustable between a first screed width and a second screed width is disclosed. The screed assembly may include a main screed portion, including a screed frame having a main deflector and a screed side plate coupled thereto. Furthermore, the screed assembly may have a screed extension portion including a screed extension portion frame, the screed extension portion being in a laterally exterior position with respect to the main screed portion. Moreover, a screed extension tube may be operably coupled to the screed frame and the screed extension portion frame, the screed extension tube configured to adjust the screed extension portion between the first screed width and the second screed width. Additionally, the screed assembly may include an extension tube support mechanism for supporting the screed extension tube when the screed assembly is adjusted between the first screed width and the second screed width. The extension tube support mechanism may include a bushing that circumferentially surrounding the screed extension tube and disposed within a bushing recess defined in the screed extension portion frame. Moreover, the extension tube support mechanism may further include a retainer ring that circumferentially surrounds and is in direct contact with at least a portion of the bushing, wherein the retainer ring is capable of being adjusted between the bushing and the screed extension portion frame to eliminate an uncontrolled movement of the screed extension tube and the screed extension portion.

In another aspect of the disclosure, a paving machine is disclosed. The paving machine includes a tractor including a frame and a hopper mounted on the frame, the hopper configured to hold a paving material to be distributed to a paving surface. The paving machine may further include a screed assembly mounted on the frame and configured to receive the paving material from the hopper. A main screed portion of the screed assembly may include a screed frame having a main deflector and a screed side plate coupled thereto. The paving machine may further include a screed extension portion of the screed assembly having a screed extension portion frame, the screed extension portion being in a laterally exterior position with respect to the main screed portion. Additionally, a screed extension tube may be operably coupled to the screed frame and the screed extension portion frame; the screed extension tube may be configured to adjust the screed extension portion between a first screed width and a second screed width. The paving machine may further include an extension tube support mechanism for supporting the screed extension tube when the screed assembly is adjusted between the first width and the second width. The extension tube support mechanism may include a bushing circumferentially surrounding the screed extension tube and disposed within a bushing recess defined in the screed extension portion frame. Furthermore, the extension tube support mechanism may include a retainer ring that circumferentially surrounds and is in direct contact with at least a portion of the bushing, wherein the retainer ring is capable of being adjusted between the bushing and the screed extension portion frame to eliminate an uncontrolled movement of the screed extension tube and the screed extension portion.

In yet another aspect of the disclosure, an extension tube support mechanism for a screed assembly including a main screed portion and a screed assembly portion that is adjustable between a first screed width and a second screed width is disclosed. The screed extension tube support mechanism may include a screed extension tube operably coupled to a screed frame and a screed extension portion frame, the screed extension tube configured to adjust the screed extension portion between the first screed width and the second screed width. Furthermore, the extension tube support mechanism may include a bushing circumferentially surrounding the screed extension tube and disposed with a bushing recess defined in the screed extension portion frame. Additionally, the extension tube support mechanism may include a retainer ring that circumferentially surrounds and is in direct contact with at least a portion of the bushing, wherein the retainer ring is capable of being adjusted between the bushing and the screed extension portion frame to eliminate an uncontrolled movement of the screed extension tube and the screed extension portion.

DETAILED DESCRIPTION

Figure 1:
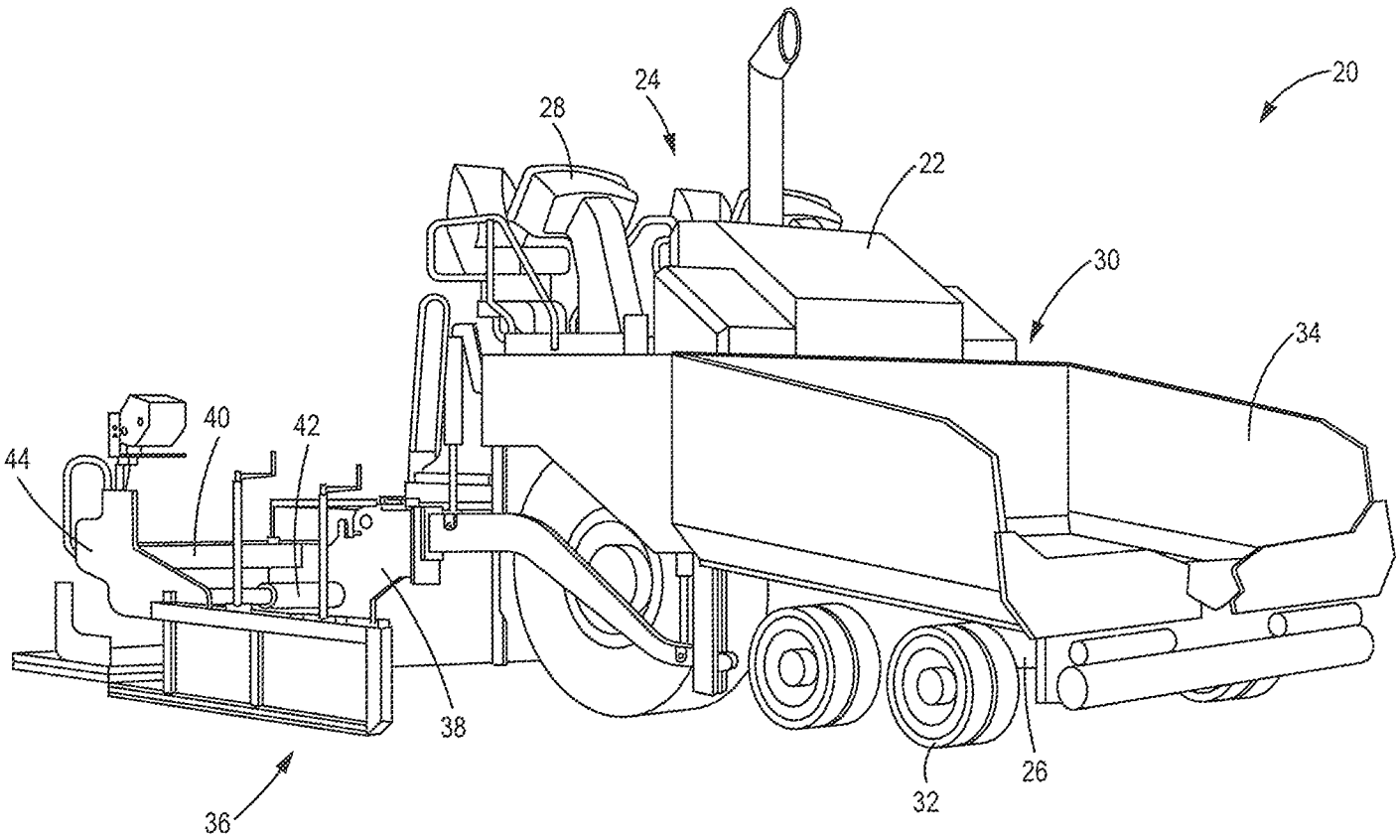
FIG. 1 is a perspective view of a paving machine having a screed with an extendible frame portion, according to the present disclosure.

An exemplary embodiment of a paving machine 20 is shown generally in FIG. 1. The paving machine 20, which may also be referred to as an asphalt paver, may be any machine used to distribute a layer of paving material, such as asphalt, on the surface of a roadway, driveway, parking lot, sidewalk or other paved area. Moreover, the paving machine 20 generally includes a tractor portion 22 which has an operator station 24 supported by a frame 26 of the paving machine 20. The operator station includes a control console 28 and other such controls for monitoring and controlling the paving machine 20. The tractor portion 22 further includes a power generation source 30 supported by the frame 26, such as an internal combustion engine, which supplies the necessary power needed to operate the paving machine 20. A set of ground-engaging propulsion elements 32 are mounted to the frame 26 and coupled to the power generation source 30 such that the operator can propel and maneuver the paving machine 20 from the console 28 or other such location in the operator station 24. Additionally, the tractor portion 22 includes hydraulic drives and controls, along with various other known paving machine components (not shown), for operating various systems and components of the paving machine 20. Furthermore, some embodiments of the paving machine 20 may be configured to allow for remote operation by an operator outside of the operator station 24. For example, an operator may be remotely located around the job site or other such location and the operator may be capable to access or otherwise control the control console 28 over a computer network to instruct and operate the paving machine 20.

In one embodiment, the paving machine 20 further includes a hopper 34 supported by the frame 26 and the hopper 34 is configured to receive a supply of paving material (e.g., asphalt) to be distributed by the paving machine 20. Moreover, a conveyor (not shown) may be operably coupled between the hopper 34 and a screed assembly 36 attached to a rear portion of the paving machine 20. The conveyor (not shown) conveys or otherwise transports the paving material from the hopper 34 towards the screed assembly 36 and the paving material is distributed along the paving surface (i.e., roadway, driveway, sidewalk or other such surface). The screed assembly 36 then smoothens and, at least partially, compacts the paving material into a mat along the desired paving surface.

Furthermore, the screed assembly 36 includes a main frame 38, and a screed extension portion 40, located laterally exterior from the main frame 38. Additionally, in some embodiments the screed assembly 36 includes one or more screed extension tubes 42 which are extendably coupled between the main frame 38 and a screed extension frame 44. Moreover, the screed extension tube 42 and/or the screed extension portion 40 is operably coupled to one or more actuation devices (not shown), such as but not limited to a hydraulic cylinder, a linear actuator or other such actuating device. As such, activation of the one or more actuation devices (not shown) can extend and retract the screed extension portion 40 to widen and/or narrow the screed assembly 36 width, as needed.

Figure 2:
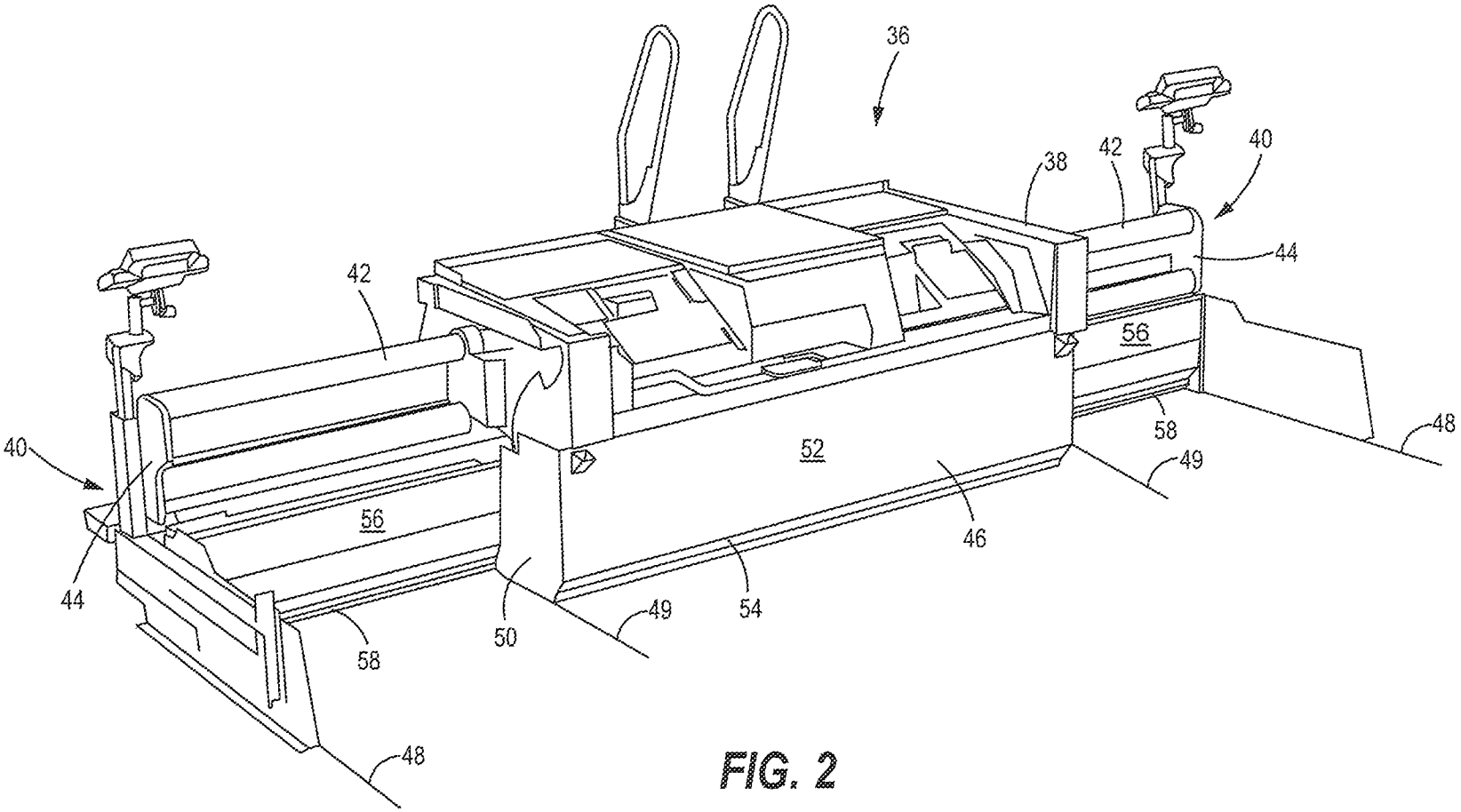
FIG. 2 is a perspective view of a screed assembly separated from the paving machine, according to an aspect of the present disclosure.

Referring now to FIG. 2, a perspective view of the screed assembly 36 is shown in greater detail and separate from the paving machine 20 of FIG. 1. The screed assembly 36 includes a central screed portion 46 with the screed extension portion 40 attached laterally exterior to each side of the central screed portion 46. Each of the screed extension portions 40 are extendably coupled to the central screed portion 46 by one or more screed extension tubes 42. Accordingly, the screed extension portions 40 are laterally extendable with respect to the central screed portion 46. As discussed above, one or more actuating devices (not shown) may be controlled by the operator of the paving machine 20 to extend and/or retract the screed extension portions 40 depending on the desired width of the surface to be paved. As shown in FIG. 2, the screed assembly 36 is adjusted into a first position 48 which fully extends each of the screed extension portions 40 outward a specified distance from a central screed side plate 50. As such, the first position 48 may represent a maximum paving width of the screed assembly 36. Moreover, each of the screed extension portions 40 may be retracted laterally inwards to a second position 49 such that the screed extension frame 44 is adjacently positioned with respect to the main frame 38 and/or the central screed side plate 50 of the screed assembly 36. Accordingly, the second position 49 may represent a minimum paving width of the screed assembly 36. While two screed extension portions 40 are shown, it will be understood that other possible arrangements of the screed assembly 36 may include one screed extension portion 40, or more than two screed extension portions 40. Additionally, the two screed extension portions 40 may be simultaneously or independently extended and retracted across a range of intermediate positions between the first position 48 and second position 49 to achieve the desired width of the screed assembly 36.

The central screed portion 46 includes a substantially vertical (i.e., within manufacturing tolerances) deflector 52 and a tamper bar 54 along a bottom portion of the deflector 52. The tamper bar 54 may serve to pre-compact the paving material that is distributed from the conveyor (not shown) prior to being compacted by the central screed portion 46. As discussed above, the central screed portion 46 additionally includes the central screed side plates 50 mounted on the laterally outward-facing sides of the central screed portion 46. In an embodiment, the central screed side plates 50 are substantially perpendicular (i.e., within manufacturing tolerances) to the central screed deflector 52. Similarly, each of the screed extension portions 40 includes a deflector 56 and a tamper bar 54 extending along the bottom edge of the deflector 56. The tamper bar 54 may serve to pre-compact the paving material distributed in front of each screed extension portion 40.

Figure 3:
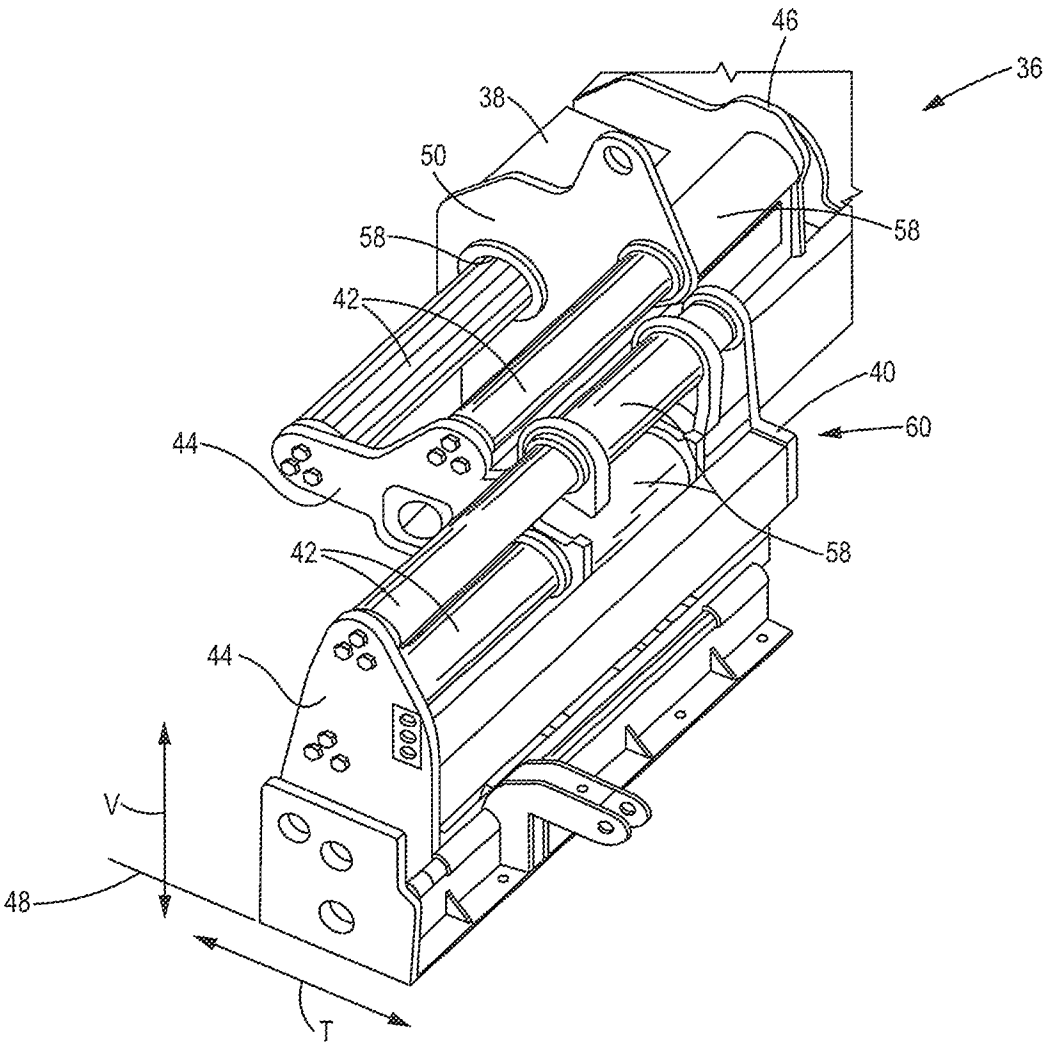
FIG. 3 is a perspective partial view of the screed assembly of FIG. 2, according to an aspect of the present disclosure.

Referring now to FIG. 3, with continued reference to FIG. 2, a portion of the screed assembly 36 is shown. As discussed above, the screed assembly 36 includes the central screed portion 46 operably coupled to the screed extension portion 40, and the screed extension portion 40 is positioned laterally exterior to the central screed portion 46. As the name suggests, the screed extension portion 40 can be extended and/or retracted to adjust the width of the screed assembly 36. Accordingly, the screed extension portion 40 is extendably coupled to the main frame 38 by at least one screed extension tube 42. FIG. 3 shows four screed extension tubes 42 that extend and/or retract the screed extension portion 40; however fewer or greater numbers of screed extension tubes 42 are possible. Moreover, for simplicity only one screed extension portion 40 is shown in FIG. 3; however at least one additional screed extension portion 40 may be positioned on the opposing end of the central screed portion 46.

In some embodiments, the screed extension tube 42 includes one or more bushings 58 that circumferentially surround an outer surface of the screed extension tube 42. The one or more bushings 58 help facilitate the extension and retraction of the screed extension tube 42 during the width adjustment of the screed assembly 36. Furthermore, the one or more bushings 58 may be incorporated into a screed extension tube support mechanism 60 that provides both movement and support to the screed extension tube 42 and screed extension portion 40 when the screed extension portion 40 is extended laterally away from the central screed portion 46. For example, when the screed extension portion 40 is in the first position 48 (i.e., extended position); the screed extension tube 42 and the one or more bushings 58 may provide support to control the movement of the screed extension portion 40. Additionally, when the screed extension portion 40 is extended a desired distance away from the central screed portion 46, the screed extension portion 40 may move up and down along a vertical axis V and/or forwards and backwards along a transverse axis T. Such movement along the vertical V and transverse T axes may generate an undesired or uncontrolled movement of the screed extension portion 40 during operation of the paving machine 20.

Figure 4:
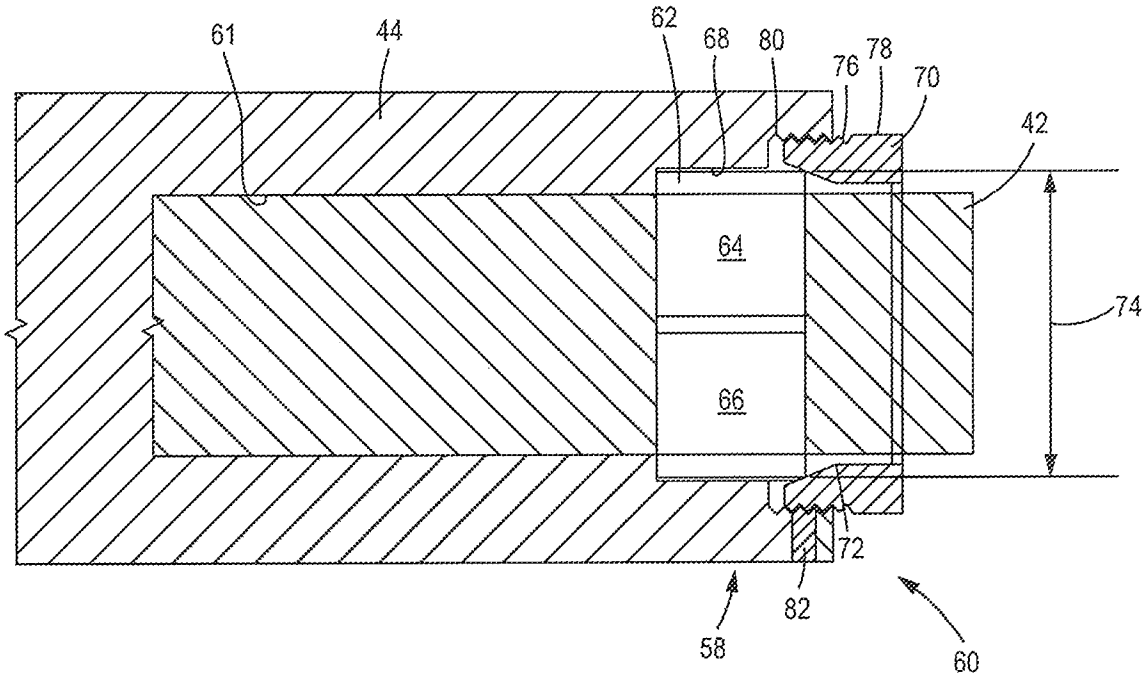
FIG. 4 is a cross-sectional partial view of a screed extension tube support mechanism incorporated with the screed assembly of FIG. 2, according to an aspect of the present disclosure.

FIG. 4 illustrates one non-limiting example of a screed extension tube support mechanism 60, as discussed above with reference to FIG. 3. A portion of the screed extension tube 42 extends into or is otherwise coupled to a portion of the screed extension frame 44. Furthermore, a portion of the screed extension tube 42 is circumferentially surrounded by the bushing 58 which helps to facilitate the extension and/or retraction of the screed extension tube 42. Moreover, in the exemplary embodiment shown in FIG. 4, the bushing 58 is a split solid bearing 62 that circumferentially surrounds the screed extension tube 42 and the split solid bearing 62 includes a first half 64 and a second half 66. The screed extension frame 44 includes a bearing recess 68 and the split solid bearing 62 fits into at least a portion of the bearing recess 68. Furthermore, a tapered compression ring 70 circumferentially surrounds the screed extension tube 42 and at least a portion of the tapered compression ring 70 directly contacts the first half 64 and the second half 66 of the split solid bearing 62 to retain or otherwise hold the split solid bearing 62 in place.

In one non-limiting example, the tapered compression ring 70 includes a tapered inner surface 72. Accordingly, an inner diameter 74 of the tapered compression ring 70 increases and/or decreases while moving along the tapered inner surface 72. Moreover, a set of threads 76 is circumferentially defined around at least a portion of an outer surface 78 of the tapered compression ring 70. An inner surface 61 of the screed extension frame 44 includes a corresponding set of threads 80 which mate with the set of threads 76 around the outer surface 78 of the tapered compression ring 70. As a result, adjusting the tapered compression ring 70 (i.e., turning clockwise or counter-clockwise) will adjust a position of the tapered compression ring 70 and increase or decrease the inner diameter 74 of the tapered compression ring 70 with respect to the split solid bearing 62. In some embodiments, the tapered compression ring 70 is rotated such that the inner diameter 74 is adjusted to compress the split solid bearing 62 onto the screed extension tube 42. As a result, the tapered compression ring 70 may be adjusted (i.e., tightened or loosened) to provide the necessary support to the screed extension tube 42 and other components to help remove and/or minimize the uncontrolled movement of the screed assembly 36. Additionally, a set screw 82 may extend through the screed extension frame 44 and align with the outer surface 78 of the tapered compression ring 70. The set screw 82 may be adjusted (i.e., loosened) to allow for adjustment of the tapered compression ring 70 and the set screw may be adjusted (i.e., tightened) to directly contact the outer surface 78 of the tapered compression ring 70 once the split solid bearing 62 is properly compressed or otherwise adjusted relative to the screed extension tube 42.

Figure 5:
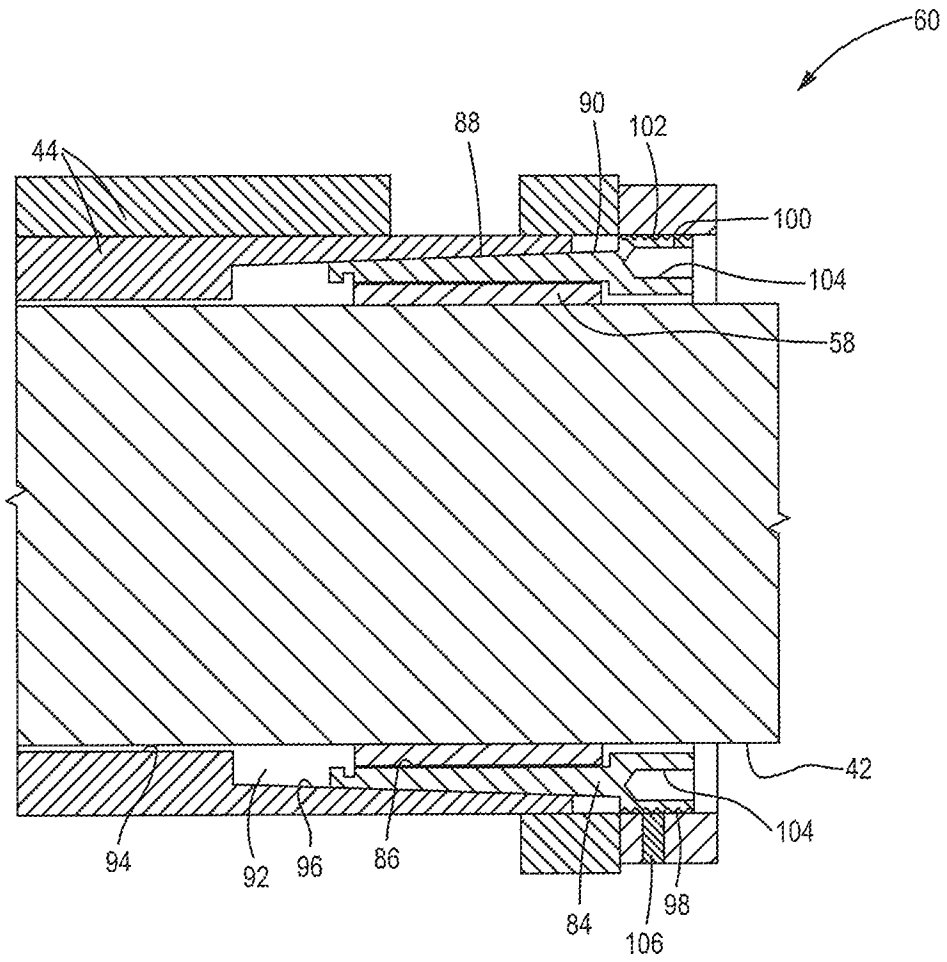
FIG. 5 is a cross-sectional partial view of a screed extension tube support mechanism incorporated with the screed assembly of FIG. 2, according to an aspect of the present disclosure.

FIG. 5 illustrates an additional embodiment of the screed extension tube support mechanism 60. A portion of the screed extension tube 42 extends into and is adjacently positioned along the inner surface 94 of the screed extension frame 44. Furthermore, a portion of the screed extension tube 42 is circumferentially surrounded by the bushing 58, which helps to facilitate the extension and/or retraction of the screed extension tube 42. An embodiment of the screed extension tube support mechanism 60 further includes a tapered retaining collar 84 that circumferentially surrounds the bushing 58. Moreover, the tapered retaining collar 84 includes a first surface 86 that is adjacently positioned to the outer surface of the bushing 58. The tapered retaining collar 84 includes a second surface 88 opposite of the first surface 86, and the second surface 88 includes a tapered surface 90. The screed extension frame 44 further includes a recess 92 defined into a portion of the inner surface 94 of the screed extension frame 44 to accommodate the bushing 58 and the tapered retaining collar 84. Additionally, a portion of the inner surface 94 includes a tapered surface 96 that is complimentary to the tapered surface 90 of the tapered retaining collar 84. As further illustrated in FIG. 5, the tapered retaining collar 84 is positioned such that the first surface 86 directly contacts the outer surface of the bushing 58 and the tapered surface 90 of the tapered retaining collar 84 directly contacts the tapered surface 96 of the screed extension frame 44.

The tapered retaining collar 84 includes a set of threads 98 circumferentially defined around a portion of an outer surface 100 of the tapered retaining collar 84. Furthermore, a portion of the inner surface 94 of the screed extension frame 44 includes a corresponding set of threads 102 which mate with the set of threads 98 around the outer surface 100 of the tapered retaining collar 84. As a result, adjusting the tapered retaining collar 84 (i.e., turning clockwise or counterclockwise) will tighten or loosen (i.e., increase or decrease) the contact between the tapered surface 90 of the tapered retaining collar 84 and the tapered surface 96 of the screed extension frame 44. This in turn may tighten or loosen the fit of the bushing around the screed extension frame 44. Put another way, tightening the tapered retaining collar 84 will cause the first surface 86 of the tapered retaining collar 84 to compress or otherwise tighten the fit of the bushing 58 around the screed extension tube 42 to provide the necessary support to the screed extension tube 42 and other components to remove and/or minimize any uncontrolled movement of the screed assembly 36.

In one non-limiting example, the uncontrolled movement of the screed assembly 36 discussed above, is characterized by an undesired movement of the screed extension portion 40 that occurs when the bushing 58 is loosely adjusted around the screed extension tube 42. As a result, the screed extension tube 42, as well as the screed extension portion 40, is able to move forwards, backwards, upwards or downwards, and such movement can have a negative impact on paving quality. In some cases, a minor adjustment issue (i.e., loose bushing 58) can cause a significant amount of uncontrolled movement at the lateral exterior portion of the screed extension portion 40. Accordingly, reducing or eliminating the uncontrolled movement of the screed extension portion 40 during paving will improve the uniformity and other such quality related characteristics of the finished paved material (i.e., asphalt) mat produced by the paving machine 20.

In one embodiment, the tapered retaining collar 84 includes one or more adjustment holes 104 for the adjustment (i.e., tightening and loosening) of the tapered retaining collar 84. For example, the one or more adjustment holes 104 may be compatible for use with a spanner wrench or other such adjustment device. Furthermore, the screed extension tube support mechanism 60 may include a set screw 106 that extends through the screed extension frame 44 and aligns with the outer surface 100 of the tapered retaining collar 84. The set screw 106 may be adjusted (i.e., loosened) to allow for adjustment of the tapered retaining collar 84 and the set screw 106 may be adjusted (i.e., tightened) to directly contact the outer surface 100 of the tapered retaining collar 84 once the bushing 58 is properly compressed or otherwise adjusted around the screed extension tube 42.

INDUSTRIAL APPLICABILITY

The present disclosure finds potential application in any paving machine 20 that utilizes one or more screed extension portions 40 to increase the available paving width. Further, the disclosure may be applicable to screed assemblies 36 with one or more extendable screed portions 40 that have a screed extension support mechanism 60. Further, the disclosure may be specifically applicable to screed extension support mechanisms 60 to help reduce or remove uncontrolled and undesired movement of the screed extension portions 40 during operation of the screed assembly 36.

The present disclosure allows for movement of the screed assembly 36 during operation in order to properly adjust the paving width and other such parameters of the screed assembly 36. The paving machine 20 performance may at least partially depend on the ability of the screed assembly 36 to be consistently and repeatedly adjusted. For example, the screed assembly 36 may include one or more screed extension tubes 42 that are coupled to the central screed portion 46 and the screed extension portion 40. The one or more screed extension tubes 42 are actuated to extend and/or retract the screed extension portion 40 such that the screed assembly 36 width is adjusted to the desired or required paving width. Furthermore, the screed extension tubes 42 may include one or more bushings 58 or bearings which help facilitate the extension and retraction of the of the screed extension portion 40. Currently, the solid bushings and/or bearings may be used with the screed extension tubes 42. Such bushings and/or bearings are typically installed using a press and interference fit, or slip fit and mechanical retention. Such installation does not allow for adjustment of the bushings and/or bearings in order to minimize or remove the uncontrolled movement of the screed assembly 36.

The present disclosure provides a screed extension tube support mechanism 60 that facilitates the consistent movement (i.e., extension and retraction) of the screed assembly 36 during extension and retraction of the screed extension portion 40. Additionally, the screed extension tube support mechanism 60 allows the bushing 58 and/or the split solid bearing 62 to be adjusted to minimize and/or reduce uncontrolled movement of the screed assembly. In other words, the screed extension support mechanism 60 allows the bushing 58 and/or the split solid bearing 62 to be adjusted (i.e., tightened or loosened) to adjust the fit of the bushing 58 and/or the split solid bearing 62 around the screed extension tube 42. Such adjustment capability allows for a reduction or elimination of uncontrolled movement of the screed assembly 36 during operation of the paving machine 20.

The screed extension tube support mechanism 60 provides a threaded interface between the screed extension frame 44, and a tapered compression ring 70 or tapered retaining collar 84. In one non-limiting example, a split solid bearing 62 circumferentially surrounds and is slidably engaged with the screed extension tube 42. The tapered compression ring 70 is inserted over an end of the screed extension tube 42 such that the tapered inner surface 72 of the tapered compression ring 70 engages with at least a portion of the split solid bearing 62. Furthermore, in an embodiment, the tapered inner surface 72 may be configured such that as the tapered compression ring 70 is tightened, the inner diameter 74 of the tapered compression ring 70 decreases and the tapered inner surface 72 interacts with the split solid bearing 62 to compress the bearing onto the surface of the screed extension tube 42. Conversely, when the tapered compression ring 70 is loosened, the inner diameter 74 of the tapered adjustment ring increases and the tapered inner surface 72 interacts with the split solid bearing 62 to decompress the bearing from the surface of the screed extension tube 42.

Additionally, the screed extension tube support mechanism 60 may provide the threaded interface between the screed extension frame 44 and a tapered retaining collar 84. Accordingly, the bushing 58 may circumferentially surround and be slidably engaged with the screed extension tube. The tapered retaining collar 84 is inserted over an end of the screed extension tube and adjacently positioned to the outer surface of the bushing 58. The tapered retaining collar 84 has a first surface 86 that corresponds to the outer surface of the bushing 58 and a second surface 88 that defines a tapered surface 90 of the tapered retaining collar 84. Furthermore, the inner surface 94 of the screed extension frame 44 includes a tapered surface 96 which corresponds and is complimentary with the tapered surface 90 of the tapered retaining collar 84. Thus, when the tapered retaining collar 84 is threaded or otherwise tightened into the screed extension frame 44, the tapered surface 90 of the tapered retaining collar 84 interacts with the tapered surface 96 of the screed extension frame 44 to compress or otherwise tighten the fit the bushing 58 around the screed extension tube 42. Conversely, when the tapered retaining collar 84 is unthreaded or otherwise loosened from the screed extension frame 44, the tapered surface 90 of the tapered retaining collar 84 interacts with the tapered surface 96 of the screed extension frame 44 to decompress or loosen the fit of the bushing 58 around the screed extension tube 42.

Moreover, although the disclosure discusses the use of the tapered compression ring 70 to adjust the fit of the split solid bearing 62 and the tapered retaining collar 84 to adjust the fit of the bushing 58, it will be understood that the components of the screed extension tube support mechanism 60 are not limited as such. Thus, the tapered compression ring 70 may be used to adjust the fit of the bushing 58 and the tapered retaining collar 84 may be used to adjust the fit of the split solid bearing 62

While aspects of the present disclosure have been particularly shown and described with reference to the embodiments above, it will be understood by those skilled in the art that various additional embodiments may be contemplated by the modification of the disclosed machines, systems and assemblies without departing from the scope of what is disclosed. Such embodiments should be understood to fall within the scope of the present disclosure as determined based upon the claims and any equivalents thereof.

What is claimed is:

1. A screed assembly for a paving machine adjustable between a first screed width and a second screed width, the screed assembly comprising:

a main screed portion, including a screed frame having a main deflector and a screed side plate coupled thereto;

a screed extension portion including a screed extension portion frame, the screed extension portion being in a laterally exterior position with respect to the main screed portion;

a screed extension tube operably coupled to the screed frame and the screed extension portion frame, the screed extension tube configured to adjust the screed extension portion between the first screed width and the second screed width; and an extension tube support mechanism for supporting the screed extension tube when the screed assembly is adjusted between the first screed width and the second screed width, the extension tube support mechanism including:

a bushing circumferentially surrounding the screed extension tube and disposed within a bushing recess defined in the screed extension portion frame, and a retainer ring that circumferentially surrounds and is in direct contact with at least a portion of the bushing, wherein the retainer ring is capable of being adjusted between the bushing and the screed extension portion frame to eliminate an uncontrolled movement of the screed extension tube and the screed extension portion.

2. The screed assembly of claim 1, wherein an outer circumference of the retainer ring includes a set of threads which mate with a set of corresponding threads defined in a portion of the screed extension portion frame, and wherein the retainer ring is rotated to adjust a position of the retainer ring between the bushing and the screed extension portion frame.

3. The screed assembly of claim 2, wherein the bushing is a split solid bearing including a first bearing half and a second bearing half, and wherein the retainer ring is a compression ring that is in direct contact with at least a portion of the first bearing half and the second bearing half.

4. The screed assembly of claim 3, wherein the compression ring includes a taper along an inner surface of the compression ring, and wherein adjustment of the compression ring tightens or loosens the split solid bearing around the screed extension tube due to the taper defined along the inner surface of the compression ring.

5. The screed assembly of claim 2, wherein the bushing circumferentially surrounds a portion of the screed extension tube and the retainer ring directly contacts an outer surface of the bushing along a first surface of the retainer ring.

6. The screed assembly of claim 5, further including a screed frame tapered surface along an inner surface of the screed frame, wherein a ring tapered surface is defined along a second surface of the retainer ring and the ring tapered surface is complimentary to the screed tapered surface, and wherein adjustment of the retainer ring tightens or loosens the bushing around the screed extension tube due to interaction between the screed frame tapered surface and the ring tapered surface.

7. The screed assembly of claim 1, further including a set screw to lock the retainer ring in place following adjustment of the retainer ring.

8. A paving machine comprising:

a tractor including a frame;

a hopper mounted on the frame, the hopper configured to hold a paving material to be distributed to a paving surface;

a screed assembly mounted on the frame and configured to receive the paving material from the hopper;

a main screed portion of the screed assembly, including a screed frame having a main deflector and a screed side plate coupled thereto;

a screed extension portion of the screed assembly including a screed extension portion frame, the screed extension portion being in a laterally exterior position with respect to the main screed portion;

a screed extension tube operably coupled to the screed frame and the screed extension portion frame, the screed extension tube configured to adjust the screed extension portion between a first screed width and a second screed width; and an extension tube support mechanism for supporting the screed extension tube when the screed assembly is adjusted between the first width and the second width, the extension tube support mechanism including:

a bushing circumferentially surrounding the screed extension tube and disposed within a bushing recess defined in the screed extension portion frame, and a retainer ring that circumferentially surrounds and is in direct contact with at least a portion of the bushing, wherein the retainer ring is capable of being adjusted between the bushing and the screed extension portion frame to eliminate an uncontrolled movement of the screed extension tube and the screed extension portion.

9. The paving machine of claim 8, wherein an outer circumference of the retainer ring includes a set of threads which mate with a set of corresponding threads defined in a portion of the screed extension portion frame, and wherein the retainer ring is rotated to adjust a position of the retainer ring between the bushing and the screed extension portion frame.

10. The paving machine of claim 9, wherein the bushing is a split solid bearing including a first bearing half and a second bearing half, and wherein the retainer ring is a compression ring that is in direct contact with at least a portion of the first bearing half and the second bearing half.

11. The paving machine of claim 10, wherein the compression ring includes a taper along an inner surface of the compression ring, and wherein adjustment of the compression ring tightens or loosens the split solid bearing around the screed extension tube due to the taper defined along the inner surface of the compression ring.

12. The paving machine of claim 9, wherein the bushing circumferentially surrounds a portion of the screed extension tube and the retainer ring directly contacts an outer surface of the bushing along a first surface of the retainer ring.

13. The paving machine of claim 12, further including a screed frame tapered surface along an inner surface of the screed frame, wherein a ring tapered surface is defined along a second surface of the retainer ring and the ring tapered surface is complimentary to the screed tapered surface, and wherein adjustment of the retainer ring tightens or loosens the bushing around the screed extension tube due to interaction between the screed frame tapered surface and the ring tapered surface.

14. The paving machine of claim 8, further including a set screw to lock the retainer ring in place following adjustment of the retainer ring.

15. An extension tube support mechanism for a screed assembly including a main screed portion and a screed extension portion that is adjustable between a first screed width and a second screed width, the screed extension tube support mechanism comprising:

a screed extension tube operably coupled to a screed frame and a screed extension portion frame, the screed extension tube configured to adjust the screed extension portion between the first screed width and the second screed width;

a bushing circumferentially surrounding the screed extension tube and disposed with a bushing recess defined in the screed extension portion frame; and a retainer ring that circumferentially surrounds and is in direct contact with at least a portion of the bushing, wherein the retainer ring is capable of being adjusted between the bushing and the screed extension portion frame to eliminate an uncontrolled movement of the screed extension tube and the screed extension portion.

16. The extension tube support mechanism of claim 15, wherein an outer circumference of the retainer ring includes a set of threads which mate with a set of corresponding threads defined in the screed extension portion frame, and wherein the retainer ring is rotated to adjust a position of the retainer ring between the bearing and the screed extension portion frame.

17. The extension tube support mechanism of claim 16, wherein the bushing is a split solid bearing including a first bearing half and as second bearing half, and wherein the retainer ring is a compression ring that is in direct contact with at least a portion of the first bearing half and the second bearing half.

18. The extension tube support mechanism of claim 17, wherein the compression ring includes a taper along an inner surface of the compression ring, and wherein adjustment of the compression ring tightens or loosens the split solid bearing around the screed extension tube due to the taper defined along the inner surface of the compression ring.

19. The extension tube support mechanism of claim 16, wherein the bushing circumferentially surrounds a portion of the screed extension tube and the retainer ring directly contacts an outer surface of the bushing along a first surface of the retainer ring.

20. The extension tube support mechanism of claim 19, further including a screed frame tapered surface along an inner surface of the screed frame, wherein a ring tapered surface is defined along a second surface of the retainer ring and the ring tapered surface is complimentary to the screed tapered surface, and wherein adjustment of the retainer ring tightens or loosens the bushing around the screed extension tube due to interaction between the screed frame tapered surface and the ring tapered surface.

* * * * *